US005625899A

United States Patent [19]

Snedeker

[11] Patent Number: 5,625,899

[45] Date of Patent: May 6, 1997

[54] FIREFIGHTERS COAT WITH ENVIRONMENTAL SEAL

[75] Inventor: Julie A. Snedeker, Northwood, N.H.

[73] Assignee: Globe Manufacturing Company, Pittsfield, N.H.

[21] Appl. No.: 549,146

[22] Filed: Oct. 27, 1995

[51] Int. Cl.[6] ..... A41D 13/00

[52] U.S. Cl. ..... 2/81; 2/85; 2/93

[58] Field of Search ..... 2/81, 82, 85, 86, 2/87, 93, 97, 108, 2

[56] References Cited

U.S. PATENT DOCUMENTS 1,773,456 8/1930 Good ..... 2/85

5,542,124 8/1996 Grilliot et al. ..... 2/81

*Primary Examiner*—Diana Biefeld

*Attorney, Agent, or Firm*—Watson Cole Stevens Davis

[57] ABSTRACT

The firefighters coat is provided with a seal which is disposed adjacent the inner surface of the coat and which extends along the lower edge portion of the coat. The lower part of the seal is stitched to the lower edge portion of the coat, and the seal extends upwardly from the lower edge portion of the coat. The seal has an elastic upper part which is normally spaced a substantial distance above the lower edge portions of the coat and is adapted to hold the upper part of the seal tight against cooperating firefighter pants even when the coat rises up as occurs when a firefighter lifts his arms or bends over.

15 Claims, 2 Drawing Sheets

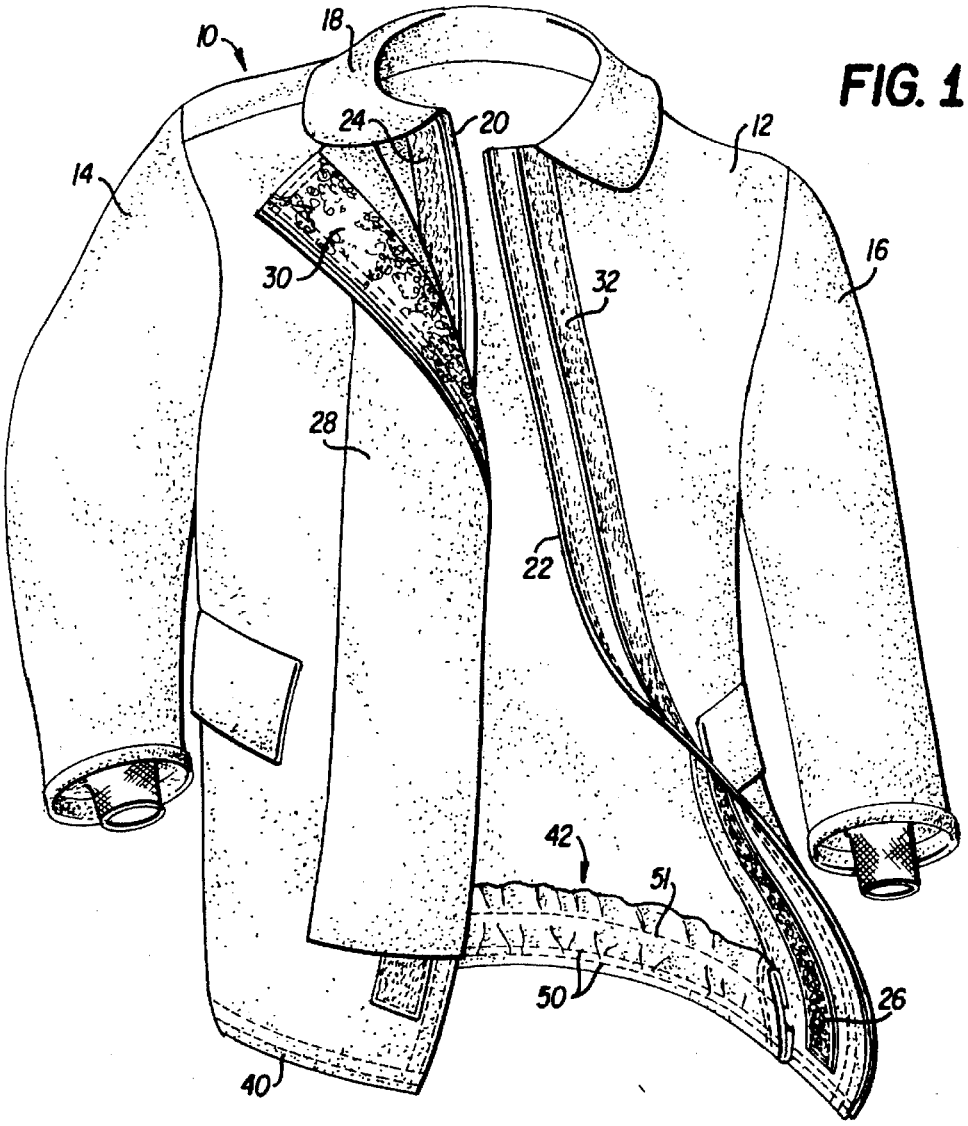
FIG. 1
FIG. 2
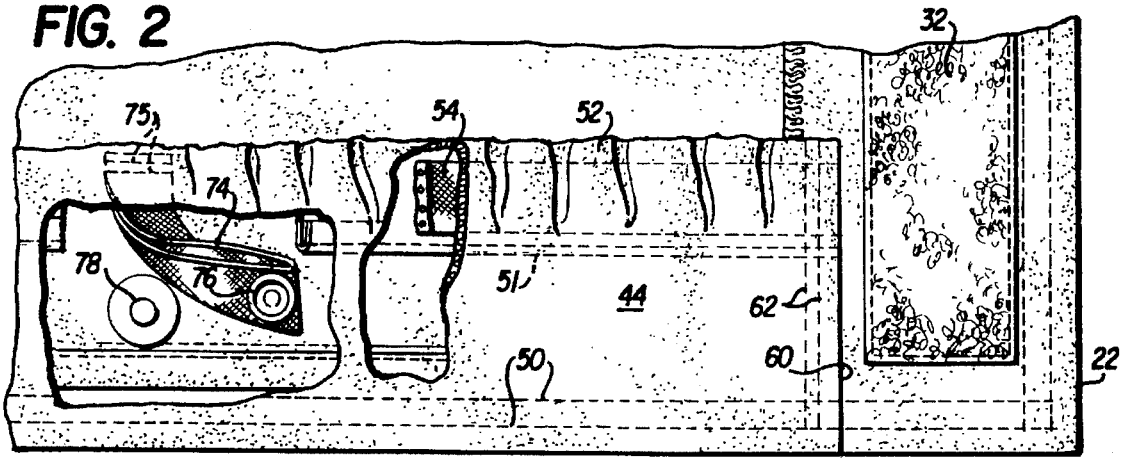

FIREFIGHTERS COAT WITH ENVIRONMENTAL SEAL

BACKGROUND OF THE INVENTION

The present invention relates to a firefighters coat having an environmental seal, and more particularly to a firefighters coat which is especially adapted for use by crash rescue personnel so as to enhance their ability to fight aircraft fires and the like. In these fires, there is the threat of exploding chemicals, burning jet fuel and other searing blasts. Crash rescue personnel often must walk into very high temperature environments for extended periods of time, and require a very high level of protection.

A particular problem exists at the interface between the lower edge portion of the coat and the pants of the firefighters suits. It is necessary to provide an environmental seal at this location to prevent penetration under the coat of radiation heat, convection heat, gas vapors, steam and other debris. The problem of maintaining an effective seal is exacerbated by the tendency of the coat to rise up when the arms are lifted or when the firefighter bends over, thereby tending to cause the seal at the interface between the coat and the pants to be broken.

It is therefore a principal objective of the invention to provide a firefighters coat which provides an effective environmental seal at the interface between the coat and a cooperating pair of pants, and which will successfully maintain a seal at the interface even when the firefighter lifts his arms or bends over.

SUMMARY OF THE INVENTION

The present invention provides a construction wherein the lower edge portion of the coat is provided with an environmental seal which extends upwardly from the lower edge portion of the coat and is disposed within the coat so as to be adjacent the inner surface of the outer shell of the coat. The seal extends along the lower edge portion of the coat so as to form a seal completely around a cooperating pair of firefighters pants. The seal includes an elastic upper part which is adapted to hold the seal tight against the pants, thereby ensuring that undesirable penetration under the coat of heat, vapors, steam and debris does not occur.

The seal includes a lower substantially nonelastic part, and a flame resistant surface of the seal faces away from the inner surface of the shell of the coat, so that the flame resistant surface is directed toward the exterior environment and will protect the firefighter.

The construction of the seal is such that the upper elastic part of the seal which is adapted to engage a pair of firefighters pants is disposed a substantial distance above the lower edge portion of the shell. When a firefighter lifts his arms or bends over, the lower edge portion of the coat tends to ride up along the torso of the firefighter, and there is a tendency for the lower edge portion of the coat to become spaced from the cooperating pants. The seal of the invention prevents such a space from occurring since as the shell moves upwardly, the upper elastic part of the seal remains in sealing engagement with cooperating pants, while the lower part of the seal is free to follow the shell in an upward direction without disturbing the seal between the upper part of the seal and the pants.

BRIEF DESCRIPTION OF THE DRAWINGS

FIG. 1 is a front view of a firefighters coat having an environmental seal according to the invention at the bottom of the coat;

FIG. 2 is an enlarged view, partly broken away, through part of the bottom of the coat showing one end of the environmental seal;

DESCRIPTION OF THE PREFERRED EMBODIMENT

Figure 4:
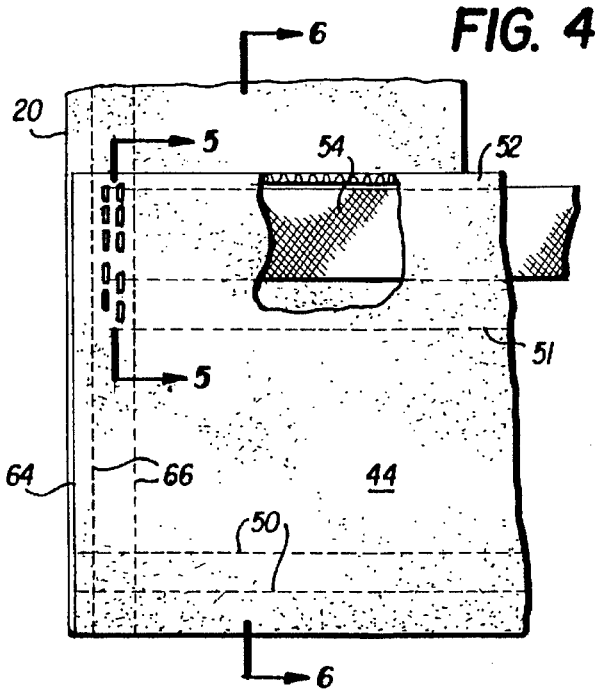
FIG. 4 is a view of the other end of the environmental seal.

Referring to the drawings wherein like reference characters designate corresponding parts throughout the several views, a firefighters coat 10 is shown in FIG. 1 and includes an outer shell having a torso portion 12, a pair of arms 14 and 16 and a collar 18. The outer shell is formed of a conventional flame resistant material such as KEVLAR having an aluminized surface which reflects away ninety per cent of radiant heat, withstands extremely high ambient temperatures and remains pliable in temperature extremes. This type of coat is usually worn with a conventional moisture barrier and thermal liner, although the invention may be employed with coats which are not used with either a conventional moisture barrier or thermal liner.

The coat has a pair of front edge portions 20 and 22. A securing means 24 is adapted to engage a securing means 26 to hold the front of the coat in closed position, the securing means being conventional hook and loop means such as VELCRO. A storm flap 28 is provided and has securing means 30 disposed on the inner surface thereof for engaging securing means 32 on the coat for holding the storm flap in closed position. Securing means 30 and 32 may also comprise VELCRO.

Figure 6:
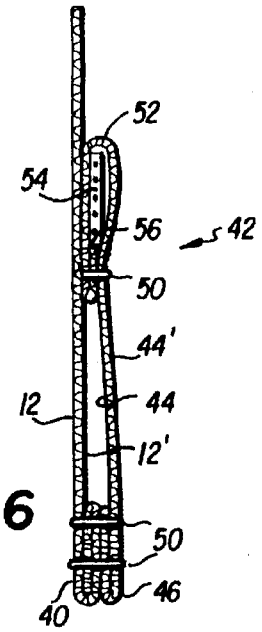
FIG. 6 is a sectional view taken along line 6—6 of FIG. 4.
Figure 5:
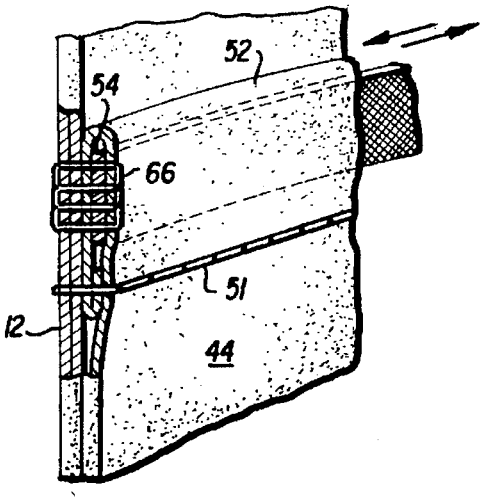
FIG. 5 is a sectional view taken along line 5—5 of FIG. 4.

The outer shell of the coat includes a lower edge portion 40, and an environmental seal 42 is secured to the lower edge portion 40 and is disposed adjacent the inner surface 12' of the shell as seen in FIG. 6. The seal comprises a piece of material 44 formed of the same material as the shell with the aluminized surface 44' of the seal facing away from the inner surface 12' of the shell.

Figure 3:
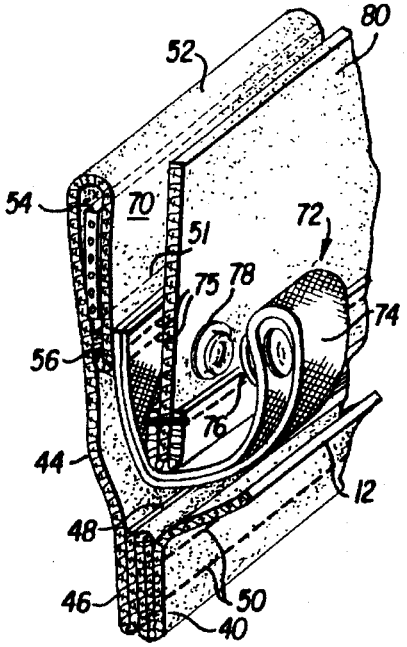
FIG. 3 is a perspective sectional view of the lower portion of the coat and the environmental seal supported thereby.

As seen in FIGS. 3 and 6, sheet of material 44 is folded over at the bottom thereof to define a lower edge portion 46 and terminates in an edge 48. Lower edge portion 46 of the sheet of material is secured to the lower edge portion of the shell by lines of stitching 50. Sheet of material 44 is folded over at the top thereof and secured to itself by a line of stitching 51 to define a tubular portion 52 which receives elastic means in the form of a band of elasticized woven fabric 54. The top of the sheet of material terminates in an edge 56.

As seen in FIG. 2, one end 60 of the sheet of material and the corresponding end of band 54 are secured to the shell by lines of stitching 62, while as seen in FIG. 4, the opposite end 64 of the sheet of material and the corresponding end of band 54 are secured to the shell by lines of stitching 66. The normal unstretched length of band 54 is substantially less than the length of the sheet of material 44 and the tubular portion 52 thereof, and for example, may be about one half the length of the sheet of material. This causes the upper tubular part of the seal to be gathered, and will constantly hold the seal in contact with a cooperating pair of pants when in use. The sheet of material has one end 60 thereof disposed adjacent to but spaced from front edge portion 22, while the opposite end 64 thereof is disposed closely adjacent front edge portion 20.

It is noted that the portion of the seal between the lines of stitching 62 and 66 is free of the shell so that the lower substantially nonelastic parts of the seal may move upwardly with the shell while allowing the elastic upper part of the seal to remain in contact with a cooperating pair of pants.

As seen in FIGS. 2 and 3, the seal includes a seal surface 70, and connecting means 72 includes a fabric loop 74 having the opposite ends secured by lines of stitching 75 to surface 70. A conventional female snap fastener 76 is mounted on loop 74 and cooperates with a male snap fastener 78 mounted on a conventional thermal liner 80. A pair of spaced connecting means is preferably provided, the connecting means serving as a means for securing the lower end of the thermal liner in place within the shell. The connecting means may be eliminated in those cases where a thermal liner is not used.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A firefighters coat comprising, a flame resistant outer shell including an inner surface and a lower edge portion, and an environmental seal disposed adjacent said inner surface, said seal extending along said lower edge portion and upwardly from said lower edge portion, said seal including an upper elastic part spaced a substantial distance above said lower edge portion and being adapted to hold said upper part of the seal tight against cooperating firefighter pants.

2. A coat as defined in claim 1 wherein said seal includes a lower substantially nonelastic part.

3. A coat as defined in claim 1 wherein said seal includes a flame resistant surface facing away from said inner surface.

4. A coat as defined in claim 1 wherein said outer shell and said seal are formed of similar material.

5. A coat as defined in claim 1 wherein said upper elastic part includes a flexible tubular portion having elastic means therein, said tubular portion and said elastic means each having a length and opposite ends, said opposite ends of the tubular portion and the elastic means being secured to said outer shell.

6. A coat as defined in claim 5 wherein the normal unstretched length of said elastic means is substantially less than the length of said tubular portion so that when in normal operative position, said elastic means causes said tubular portion to be gathered.

7. A coat as defined in claim 1 wherein the lower part of said seal is stitched to said lower edge portion.

8. A coat as defined in claim 1 wherein said upper elastic part of said seal has opposite ends, said opposite ends being secured to said shell, the portion of said upper part between said opposite ends being free of said shell.

9. A coat as defined in claim 1 wherein said seal has a seal surface facing toward said inner surface, and connecting means secured to said seal surface for connecting said seal to a cooperating thermal liner.

10. A firefighters coat comprising, an outer shell including an inner surface and a lower edge portion having opposite ends, said shell having a pair of front edge portions extending upwardly from said opposite ends, and an environmental seal extending upwardly from said lower edge portion and being disposed adjacent said inner surface, said seal extending from a point adjacent one of said front edge portions to a point adjacent the other of said front edge portions so as to form a seal completely around cooperating firefighters pants when the coat is closed, said environmental seal comprising an elongated piece of material having upper and lower edge portions, said lower edge portion of the piece of material being stitched to said lower edge portion of the shell, said upper edge portion of the piece of material being folded over and secured to said piece of material to define a flexible tubular portion, and an elastic band disposed within said tubular portion to form an upper elastic part of the environmental seal for holding said tubular portion tight against cooperating firefighter pants.

11. A coat as defined in claim 10 wherein the portion of said piece of material between said tubular portion and said lower edge portion of the piece of material is substantially nonelastic.

12. A coat as defined in claim 10 wherein said piece of material includes a flame resistant surface facing away from said inner surface of the shell.

13. A coat as defined in claim 10 wherein said tubular portion and said band each have a length and opposite ends, said opposite ends of the tubular portion and the band being stitched to said outer shell, and the normal unstretched length of said band being substantially less than the length of said tubular portion so that when in normal operative position, said band causes said tubular portion to be gathered.

14. A coat as defined in claim 10 wherein said upper elastic part of the environmental seal has opposite ends which are secured to said shell, the portion of said upper elastic part between said opposite ends being free of said shell.

15. A coat as defined in claim 10 wherein said piece of material has a seal surface facing toward said inner surface of the shell, and connecting means secured to said seal surface for connecting said environmental seal to a cooperating thermal liner.

* * * * *